US010458621B2

(12) United States Patent
Terumichi

(10) Patent No.: US 10,458,621 B2
(45) Date of Patent: Oct. 29, 2019

(54) SHARPENER AND A LIGHTING FIXTURE

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 15/564,894

(22) PCT Filed: Apr. 8, 2016

(86) PCT No.: PCT/JP2016/061557

§ 371 (c)(1),
(2) Date: Oct. 6, 2017

(87) PCT Pub. No.: WO2016/163521

PCT Pub. Date: Oct. 13, 2016

(65) Prior Publication Data

US 2018/0100633 A1 Apr. 12, 2018

(30) Foreign Application Priority Data

Apr. 10, 2015 (JP) ..... 2015-081269

(51) Int. Cl.

| | |
|---|---|
| ***F21V 5/04*** | (2006.01) |
| ***F21V 7/06*** | (2006.01) |
| ***F21V 11/02*** | (2006.01) |
| ***F21V 13/10*** | (2006.01) |
| ***F21S 8/02*** | (2006.01) |
| ***F21V 7/00*** | (2006.01) |

(52) U.S. Cl.

CPC ..... *F21V 5/043* (2013.01); *F21V 5/046* (2013.01); *F21V 7/06* (2013.01); *F21V 11/02* (2013.01); *F21V 13/10* (2013.01); *F21S 8/02* (2013.01); *F21V 7/0025* (2013.01)

(58) Field of Classification Search

CPC ..... F21V 11/02; F21V 11/04; F21V 11/06; F21V 11/065; F21V 7/043; F21K 9/60; F21K 9/62

USPC ..... 362/304

See application file for complete search history.

(56) References Cited

U.S. PATENT DOCUMENTS 1,675,731 A * 7/1928 Schofield ..... F21V 11/00 362/291
1,864,696 A * 6/1932 Steele ..... G03B 21/2066 362/300
8,858,036 B2 * 10/2014 Guercio ..... F21V 7/0025 362/297

(Continued)

FOREIGN PATENT DOCUMENTS

JP H1-91999 U 6/1989
JP 2014-56660 A 3/2014
JP 2015-128048 A 7/2015

*Primary Examiner* — Alexander K Garlen
(74) *Attorney, Agent, or Firm* — Metrolex IP Law Group, PLLC

(57) ABSTRACT

A sharpener comprises a cylindrical inner louver portion and a cylindrical outer louver portion each disposed concentrically about an axis that extends forward from a center of a light-emitting surface. Respective back ends of the inner louver portion and the outer louver portion are disposed nearer to the light-emitting surface, and respective front ends and are disposed farther from the light-emitting surface, and the front end of the inner louver portion is disposed nearer to the light-emitting surface than the front end of the outer louver portion is.

7 Claims, 7 Drawing Sheets

(56) References Cited

U.S. PATENT DOCUMENTS

| | | | | |
|---|---|---|---|---|
| 2004/0165388 | A1* | 8/2004 | Shoji | F21V 5/045 362/304 |
| 2007/0030692 | A1* | 2/2007 | Waring | G02B 6/0006 362/582 |
| 2008/0278952 | A1* | 11/2008 | Trott | F21S 8/02 362/299 |
| 2014/0192539 | A1* | 7/2014 | Yriberri | F21V 7/0025 362/308 |

* cited by examiner

SHARPENER AND A LIGHTING FIXTURE

TECHNICAL FIELD

The present invention relates to a sharpener for controlling direct light from a light source and reflected light from a reflector, and a lighting fixture comprising the sharpener.

BACKGROUND

The applicant proposed a sharpener, in a lighting fixture, for controlling direct light from a light source and reflected light from a reflector and for emitting controlled light (see Japanese patent application number 2014-174614).

This sharpener comprises an inner louver portion and an outer louver portion, each formed cylindrically. The inner louver portion and the outer louver portion are disposed concentrically around a common axis, and are disposed to be inserted into a light emission outlet of the reflector.

The sharpener is provided for the purpose of producing a relatively sharp edged light. In other words, a region irradiated by the light that passed inside of the inner louver portion, and a region irradiated by the light that passed between the inner louver portion and the outer louver portion are relatively distinctively distinguished from each other, and clear irradiation is performed.

PRIOR ART DOCUMENT

Patent document 1: Japanese patent application number 2014-174614

SUMMARY OF THE INVENTION

Problems to be Solved by the Invention

However, the sharpener described above is configured aiming for producing a sharp edged light, and therefore is not always preferable for producing soft light.

In view of the circumstance described above, an aim of the present invention is to provide a sharpener capable of producing soft light, and a lighting fixture comprising the sharpener.

Means for Solving the Problems

The invention according to claim 1 is characterized in that a sharpener comprises a cylindrical inner louver portion and a cylindrical outer louver portion that are concentrically disposed around an axis that extends forward from the center of a light-emitting surface, wherein a back end of the inner louver portion and a back end of the outer louver portion are disposed nearer to the light-emitting surface, and a front end of the inner louver portion and a front end of the outer louver portion are disposed farther from the light-emitting surface, and the front end of the inner louver portion is disposed nearer to the light-emitting surface than the front end of the outer louver portion. In addition, the back end of the inner louver portion is disposed nearer to the light-emitting surface than the back end of the outer louver portion. In a cross section of the sharpener, wherein the cross section is cut by a plane that includes the axis, when the axis is used to define a boundary to divide into a first side and a second side in the cross section, and when a straight line that passes through a back end side inner periphery edge of the outer louver portion located on the first side and also passes through a front end side inner periphery edge of the outer louver portion located on the second side is defined as a first reference line, a portion of a front end side outer periphery edge of the inner louver portion appeared on the first side in the cross section is located on the first reference line or forward than the first reference line. The distance from the axis to a back end side outer periphery edge of the inner louver portion is longer than the distance from the axis to an edge portion of the light-emitting surface.

The invention according to claim 3 is characterized in that the sharpener according to claim 1 comprises a condenser lens disposed in the vicinity of the back end of the inner louver portion, and when a straight line that passes through an edge portion of the light-emitting surface on the second side in the cross section and also passes through the center of the condenser lens is defined as a second reference line, a portion of the front end side inner periphery edge of the inner louver portion appeared on the first side in the cross section is located on the second reference line or backward than the second reference line.

The invention according to claim 6 is characterized in that, in the sharpener according to claim 1, when a straight line that passes through an edge portion of the light-emitting surface on the first side in the cross section and also passes through the front end side inner periphery edge on the first side of the outer louver portion is defined as a third reference line, the back end side outer periphery edge of the inner louver portion is located on the third reference line or a portion nearer to the axis than the third reference line.

The invention according to claim 8 is characterized in that the sharpener according to claim 1 comprises an annular mounting ring portion disposed outside of the outer louver portion, a first arm portion coupling the inner louver portion and the outer louver portion, and a second arm portion coupling the outer louver portion and the mounting ring portion.

The invention according to claim 9 is characterized in that, in the sharpener according to claim 8, the inner louver portion, the first arm portion, the outer louver portion, the second arm portion, and the mounting ring portion are integrally formed.

The invention according to claim 10 is characterized in that a lighting fixture comprises a light source whose axis passing through the center of the light-emitting surface, a reflector for reflecting light from the light-emitting surface, and a sharpener for controlling light from the light-emitting surface and the reflector and for emitting controlled light, wherein the sharpener is the sharpener according to claim 8.

The invention according to claim 11 is characterized in that, in the lighting fixture according to claim 10, when the light emitted from inside of the inner louver portion of the sharpener is defined as a first emission light, and when the light emitted from between the inner louver portion and the outer louver portion is defined as a second emission light, and when the light emitted from between the outer louver portion and the mounting ring portion is defined as a third emission light, and when emission angles of the first emission light, the second emission light, and the third emission light in the cross section are respectively defined as a first emission angle, a second emission angle, and a third emission angle, then each of the first emission angle, the second emission angle, and the third emission angle is within ±5 degrees from a predefined emission angle.

Effects of the Invention

According to the invention of claim 1, the sharpener comprises the inner louver portion and outer louver portion, each has a cylindrical shape. The inner louver portion and the outer louver portion are disposed concentrically around a common axis that extends forward from the center of the light-emitting surface. Respective back ends of the inner louver portion and outer louver portion are disposed nearer to the light-emitting surface, and their respective front ends are disposed farther from the light-emitting surface. In addition, the front end of the inner louver portion is located nearer to the light-emitting surface than the front end of the outer louver portion is.

As described above, the front end of the inner louver portion of the sharpener is located nearer to the light-emitting surface than the front end of the outer louver portion is. Therefore, among the light that enters from the back end of the inner louver portion and passes through the inside of the inner louver portion and goes out from the front end of the inner louver portion, the amount and the emission angle of the light that travels away from the axis can be increased, compared with a case where the front end of the inner louver portion and the front end of outer louver portion are located at a same position. In addition, among the light that enters from the back end at a gap between the inner louver portion and the outer louver portion and passes through the gap and goes out from the front end, the amount and the emission angle of the light that approaches the axis can be increased. In addition, by adjusting the position of the front end of the inner louver portion as appropriate, the emission angle of the light emitted from inside of the inner louver portion can be made substantially same as the emission angle of the light emitted from the gap between the inner louver portion and the outer louver portion. In this case, a substantially same region is irradiated by the light emitted from inside of the inner louver portion and by the light emitted from the gap between the inner louver portion and the outer louver portion, thereby soft light is obtained.

The portion of the front end side outer periphery edge of the inner louver portion appeared on the first side in the cross section is located on the first reference line or forward than the first reference line.

This configuration allows the inner louver portion to adjust (control) the amount and the emission angle of the light that approaches the axis, among the light emitted from between the inner louver portion and the outer louver portion.

In an opposite situation, i.e., if the front end side outer periphery edge of the inner louver portion is located backward than the first reference line, then the light that passes on the first reference line does not strike the front end of the inner louver portion. As a result, the front end of the inner louver portion is no longer capable of controlling (adjusting) the amount and the emission angle of the light that passes through the gap between the inner louver portion and the outer louver portion and then approaches the axis. In addition, the back end of the inner louver portion is disposed nearer to the light-emitting surface than the back end of the outer louver portion. This configuration allows the inner louver portion to increase the amount of light that goes out from the light-emitting surface and enters from the back end of the inner louver portion. In addition, the distance from the axis to the back end side outer periphery edge of the inner louver portion is longer than the distance from the axis to the edge portion of light-emitting surface. As a result, the inner louver portion can prevent direct light that approaches the axis from being included in the light that goes out from the light-emitting surface and then goes out from the gap between the inner louver portion and the outer louver portion.

According to the invention of claim 3, the portion of the front end side inner periphery edge of the inner louver portion appeared on the first side in the cross section is located on the second reference line or backward than the second reference line.

As a result, the inner louver portion does not reduce the amount of light that goes out from the light-emitting surface and passes through the center of the condenser lens and then passes through inside of the inner louver portion.

In an opposite situation, i.e., if the front end side inner periphery edge of the inner louver portion is located forward than the second reference line, then the amount and the emission angle of the light emitted from inner louver portion would be reduced.

According to the invention of claim 6, the back end side outer periphery edge of the inner louver portion is located on the third reference line or nearer to the axis than the third reference line is.

In this case, the light that goes out from near the edge portion of the light-emitting surface passes through the gap between the inner louver portion and the outer louver portion, and is then emitted as direct light traveling away from the axis.

According to the invention of claim 8, the sharpener comprises the inner louver portion, the outer louver portion, the annular mounting ring portion disposed outside of the outer louver portion, the first arm portion connecting the inner louver portion and the outer louver portion, and the second arm portion connecting the outer louver portion and the mounting ring portion.

Therefore, by holding the mounting ring portion inside of a hood by means of the hood, the inner louver portion and the outer louver portion can be disposed at predefined positions.

According to the invention of claim 9, in the sharpener, the inner louver portion, the first arm portion, the outer louver portion, the second arm portion, and the mounting ring portion are integrally formed.

As a result, the number of components and thus the number of assembly steps can be reduced, compared with a case where these components are separately formed and then assembled.

According to the invention of claim 10, the lighting fixture comprises the light source whose axis passing through the center of the light-emitting surface, the reflector for reflecting light from the light-emitting surface, and the sharpener for controlling light from the light-emitting surface and the reflector and for emitting controlled light, and the sharpener comprises the mounting ring portion, the inner louver portion, the outer louver portion, the first arm portion, and the second arm portion.

According to the invention of claim 11, the lighting fixture is configured such that each of the first emission angle, the second emission angle, and the third emission angle is within ±5 degrees from a predefined emission angle.

With this configuration, regions irradiated by each of the first emission light, the second emission light, and the third emission light substantially overlay one another. Therefore, an irradiated region with soft and highly uniform light as a whole can be obtained.

EMBODIMENTS FOR IMPLEMENTING THE INVENTION

Figure 1A:
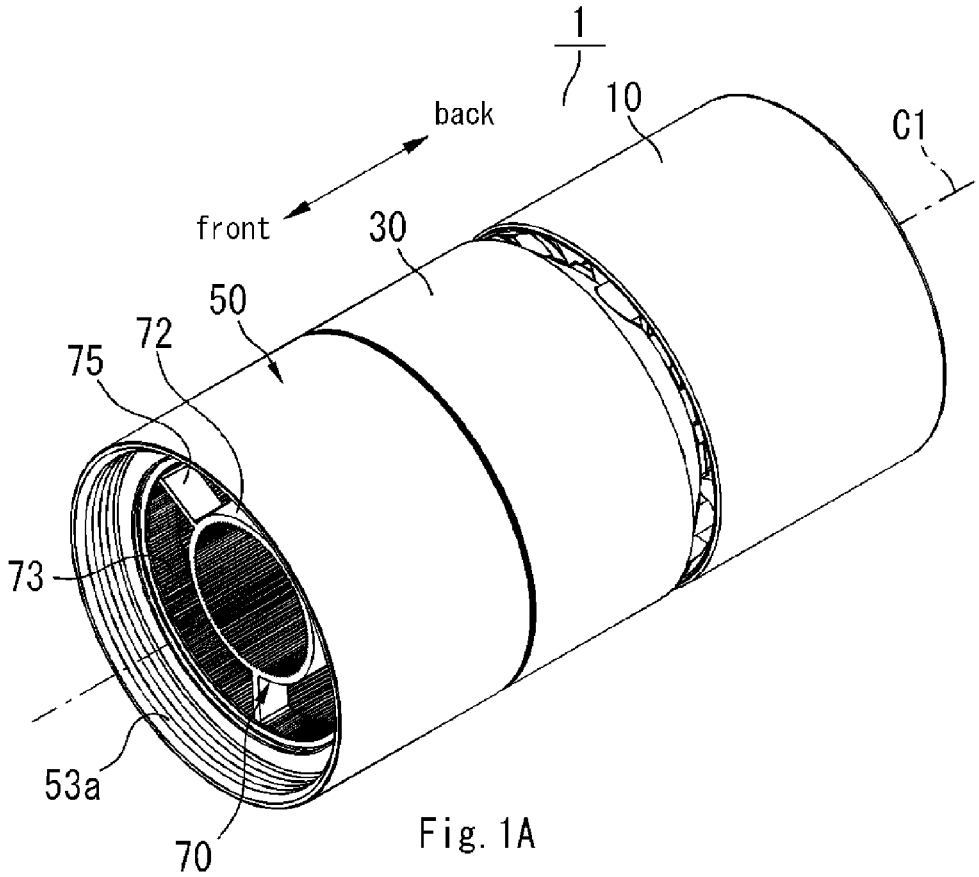
FIG. 1A is an oblique view of a lighting fixture 1 viewed from its front end side.

Embodiments, to which the present invention is applied, are described in detail with reference to drawings. In drawings, like or similar components are designated by the same reference numerals, and duplicate explanation for such components is omitted as appropriate. In addition, in drawings, components that are not needed for explanation are omitted as appropriate.

Embodiment 1

A lighting fixture 1 according to an embodiment 1 to which the present invention is applied, and a sharpener 70 used for the lighting fixture 1 are described with reference to FIGS. 1A through 6. For the purpose of explanation, in the description below, directions designated as "back" and "front" indicated by arrows along the axis (optical axis) C1 in FIG. 1A and FIG. 2A respectively correspond to "back (backward, back end side)" and "front (forward, front end side)" of the lighting fixture 1, the sharpener 70, and other components.

The "sharpener" herein may be grouped in a same category as a general glare-cut louver, and refers to an optical controlling apparatus capable of finely adjusting the distribution of light of an optical reflector, which is a primary optical system.

The lighting fixture 1 is described with reference to FIG. 1A, FIG. 1B, FIG. 2A, FIG. 2B and FIG. 2C.

Figure 1B:
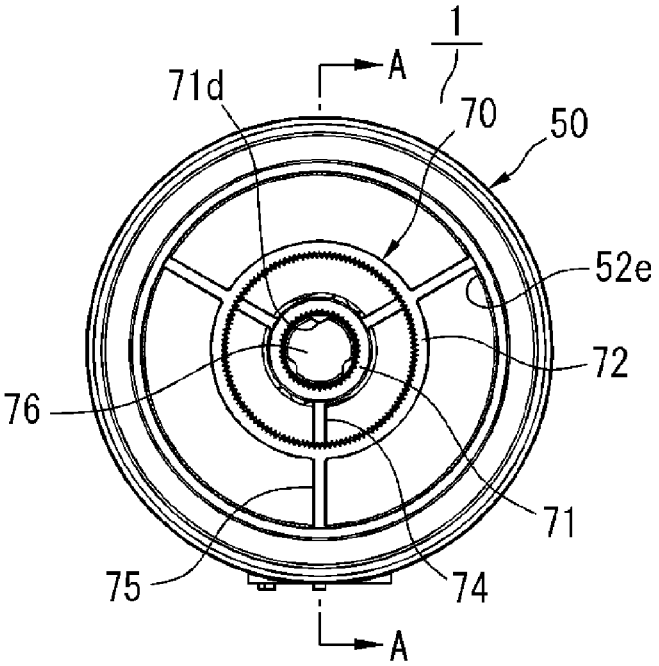
FIG. 1B is a front view of the lighting fixture 1 viewed from its front end side.
Figure 2A:
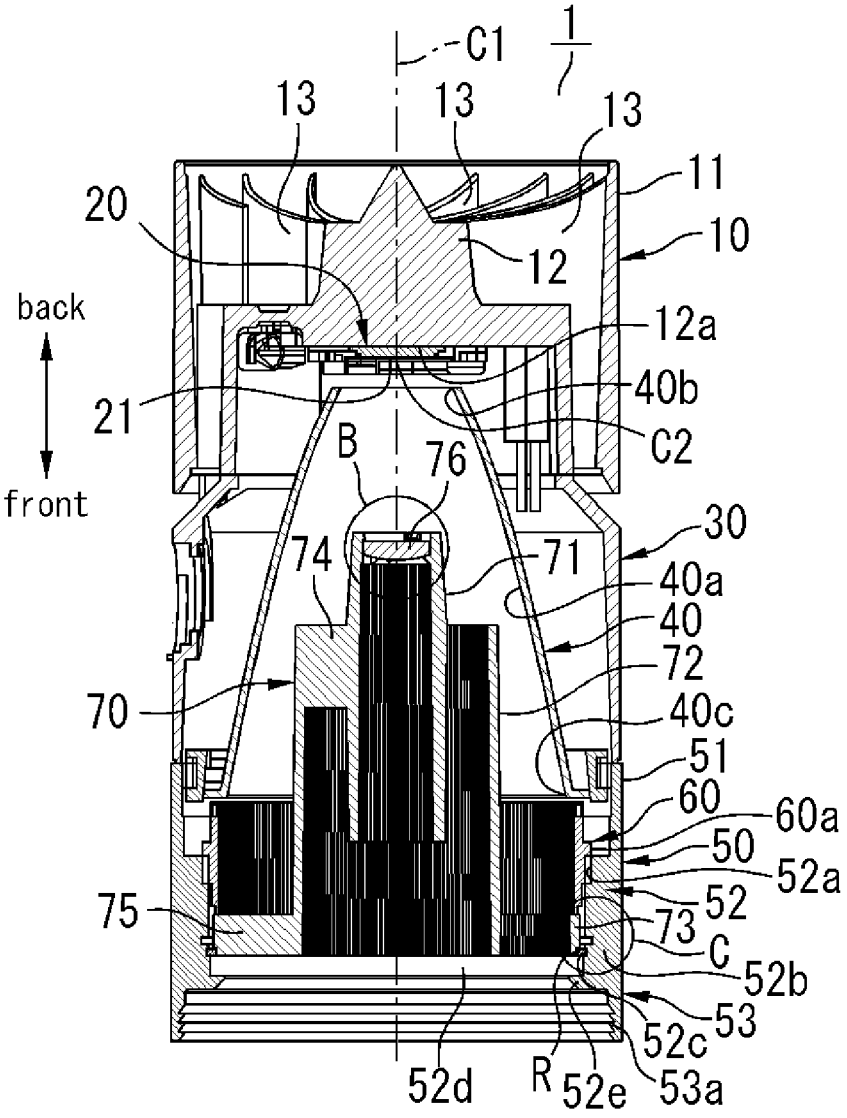
FIG. 2A is a view cut along A-A line in FIG. 1B.
Figure 2B:
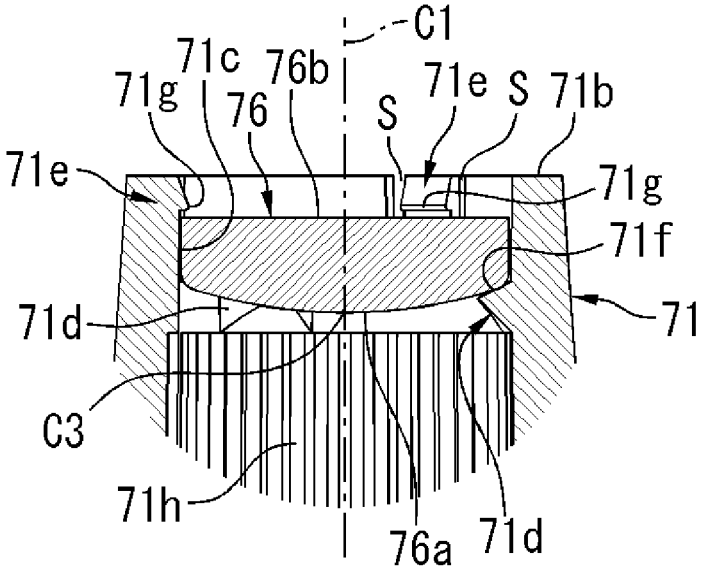
FIG. 2B is an enlarged view of portion B in FIG. 2A.
Figure 2C:
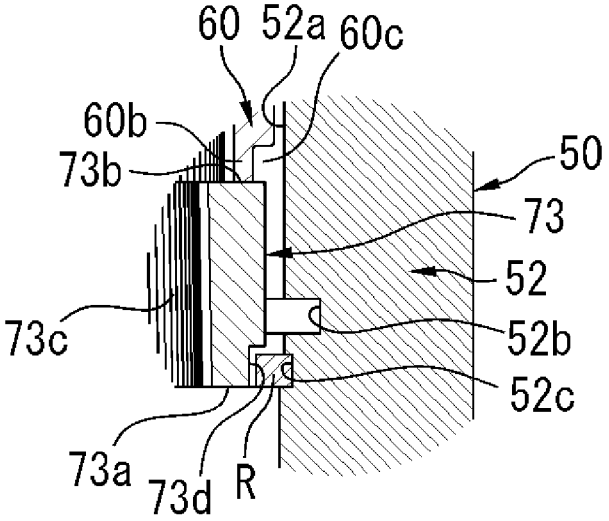
FIG. 2C is an enlarged view of portion C in FIG. 2A.

FIG. 1A is an oblique view of the lighting fixture 1 viewed from obliquely front, and FIG. 1B is a front view of the lighting fixture 1. FIG. 2A is a view cut along A-A line in FIG. 1B, and FIG. 2B is an enlarged view of portion B in FIG. 2A, and FIG. 2C is an enlarged view of portion C in FIG. 2A.

The lighting fixture 1 comprises a socket 10, a light source 20, a body 30, a reflector 40, a hood 50, a holder 60, and a sharpener 70, located in this order substantially sequentially from the back. These components are each formed as a substantially solid of revolution about the axis C1.

The socket 10 comprises a cylindrical outer wall 11, a heatsink 12 disposed inside of the outer wall 11, and a plurality of heat dissipation fins 13 radially disposed between the heatsink 12 and the outer wall 11. A front surface (lower surface) of the heatsink 12 is substantially flat, and is a light source mounting surface 12*a*.

The light source 20 is mounted onto the light source mounting surface 12*a*. For example, a COB chip on-board type (COB type) planar light source may be used for the light source 20. The light source 20 has a planar light-emitting surface 21, and the axis C1 passes through the center C2 of the light-emitting surface 21. The light-emitting surface 21 is orthogonal to the axis C1. In the description below, a case is used as an example where the light-emitting surface 21 is planar, and is a circular having a diameter d1 (see FIG. 5), in other words, where the diameter of an edge portion 21*a* (see FIG. 5) of the light-emitting surface 21 is d1. The diameter d1 of the light-emitting surface 21 is set to be smaller than the diameter d2 of a back end side outer periphery edge a of an inner louver portion 71 of the sharpener 70, which is described later (d1<d2).

The body 30 has a substantially cylindrical shape, and its back end portion is fixed to a front end portion of the socket 10 described above.

The reflector 40 is formed as a solid of revolution, which is obtained by rotating, for example, a portion of a parabola around the axis C1. Inside of the reflector 40 is a parabolic reflection surface 40*a*. A light incident inlet (opening) 40*b* is formed in a back end of the reflector 40, opposing the light source 20. A light emission outlet (opening) 40*c* facing forward is formed in a front end of the reflector 40. The back end side of the reflector 40 is housed in the socket 10, and the front end side of the reflector 40 is housed in the body 30. The reflector 40 reflects the light, which goes out from the light-emitting surface 21 and then enters from the light incident inlet 40*b*, on the reflection surface 40*a*. The reflected light is emitted from the light emission outlet 40*c* as controlled reflected light.

The hood 50 has a substantially cylindrical shape. The hood 50 comprises a back portion 51, a middle portion 52, and a front portion 53, in this order from the back. The back portion 51 and the front portion 53 each have a cylindrical shape with a relatively thin thickness, and the middle portion 52 has a cylindrical shape with a relatively thick thickness.

The back portion 51 has a tube shape with a thin thickness, and the vicinity of its back end is mounted onto a front end portion of the body 30.

The middle portion 52 comprises a female screw portion 52*a*, a relief portion 52*b*, a ring engagement groove 52*c*, a protective glass housing portion 52*d*, and a support protruding portion 52*e*, each formed on the inner peripheral surface in this order from the back. A male screw portion 60*a* of the holder 60, which is described later, is screwed into the female screw portion 52*a*. The relief portion 52*b* is a space for a tool (not shown) when the female screw portion 52*a* is worked. The ring engagement groove 52*c* has a concave shape provided all around the inner periphery surface. A snap ring R having elasticity is engaged with the ring engagement groove 52*c*. The snap ring R is provided for supporting a mounting ring portion 73 of the sharpener 70, which is described later, from the front. The protective glass housing portion 52*d* is a space for housing protective glass (not shown) therein, for example when the protective glass needs to be mounted as required by laws or regulations. The support protruding portion 52*e* is rectangular in cross section, and is protruding all around the inner periphery surface. In a case where the protective glass described above needs to be mounted, a peripheral edge of a front surface of the protective glass is mounted on the support protruding portion 52*e*, and then a peripheral edge of a back surface of the protective glass is retained by the snap ring R.

In the front portion 53, which is located front side of the middle portion 52, a baffled portion 53*a* is provided on the inner peripheral surface along a circumferential direction.

The holder 60 has a substantially cylindrical shape, and is mounted inside of the hood 50 described above. The diameter of the holder 60 is substantially same as the diameter of the light emission outlet 40*c* of the reflector 40, as illustrated in FIG. 2A. The male screw portion 60*a* to be screwed into the female screw portion 52*a* of the hood 50 is formed (threaded) in a middle portion in a front-back direction on the outer periphery surface of the holder 60. The holder 60 has a pressing portion 60*b* at its front end. The pressing portion 60*b* is provided for the purpose of pressing the mounting ring portion 73 of the sharpener 70, which is described later, from the back. An annular notch portion 60*c* is formed outside of the pressing portion 60*b* all around. The annular notch portion 60*c* is provided for the purpose of avoiding interference with the snap ring R when the sharpener 70 is not used. The holder 60 holds the mounting ring portion 73 of the sharpener 70 between itself and the snap ring R.

The sharpener 70 is described with reference to FIGS. 3 to 6.

Figure 3:
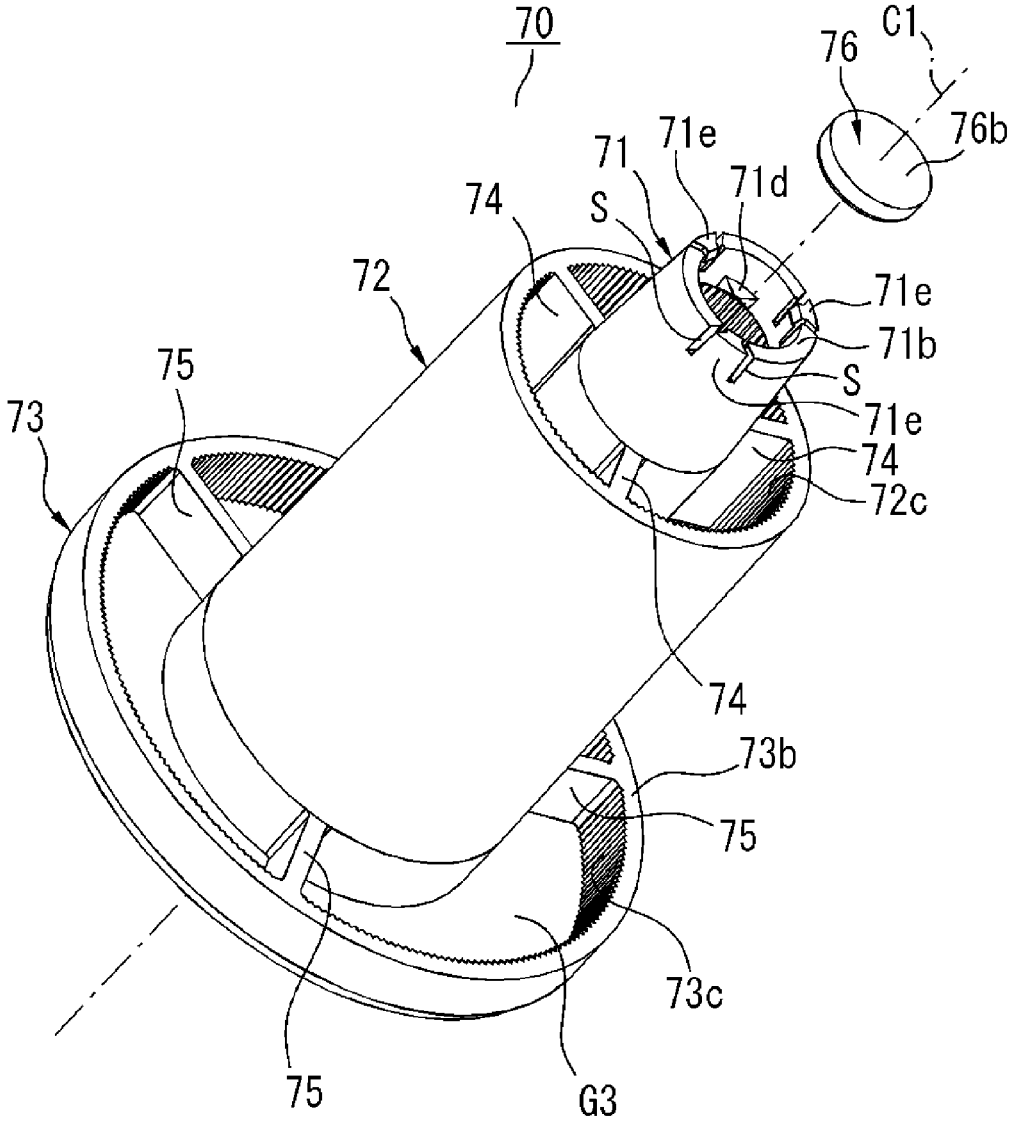
FIG. 3 is an exploded oblique view of a sharpener 70 viewed from its back end side.
Figure 4:
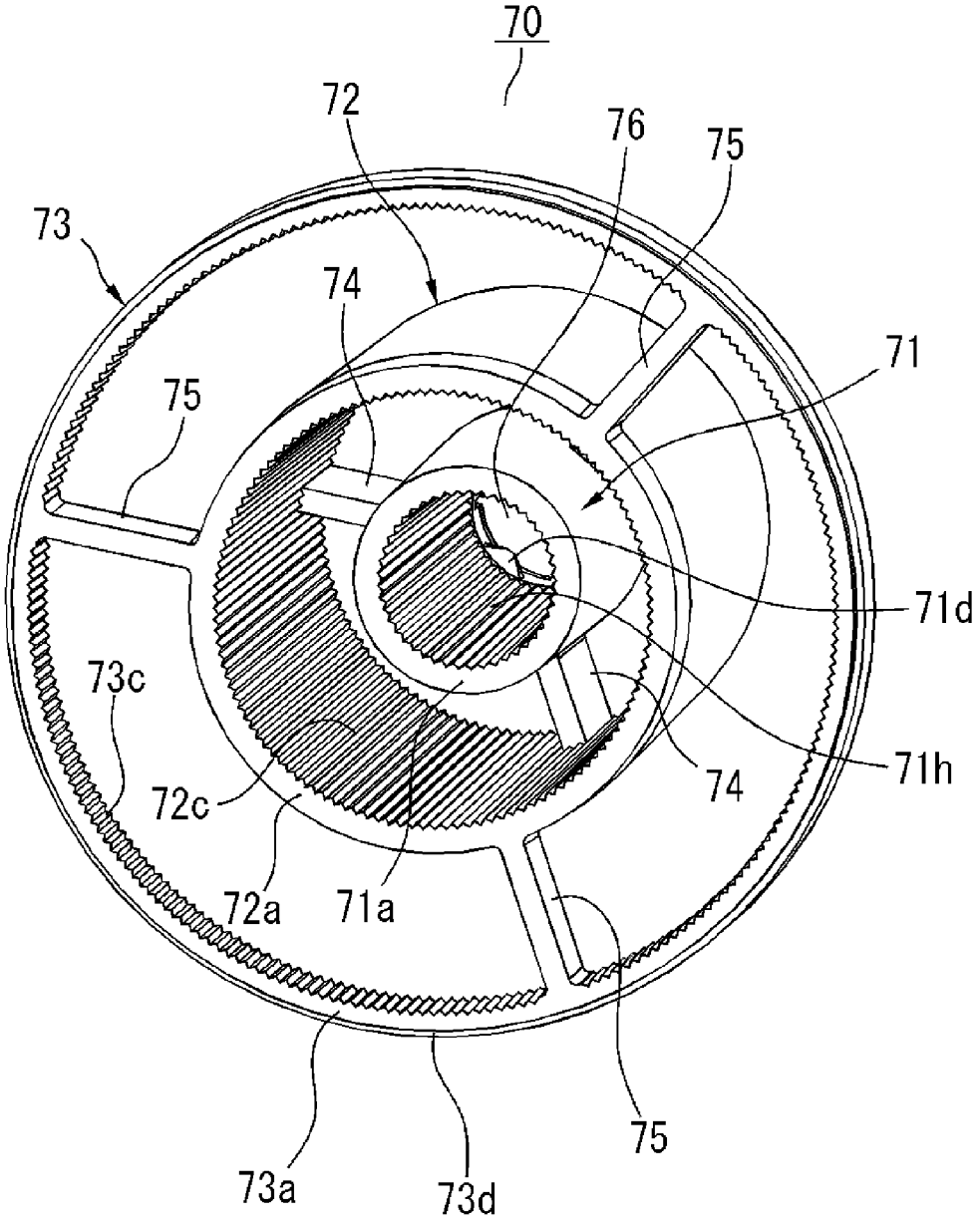
FIG. 4 is an oblique view of the sharpener 70 viewed from its front end side.
Figure 5:
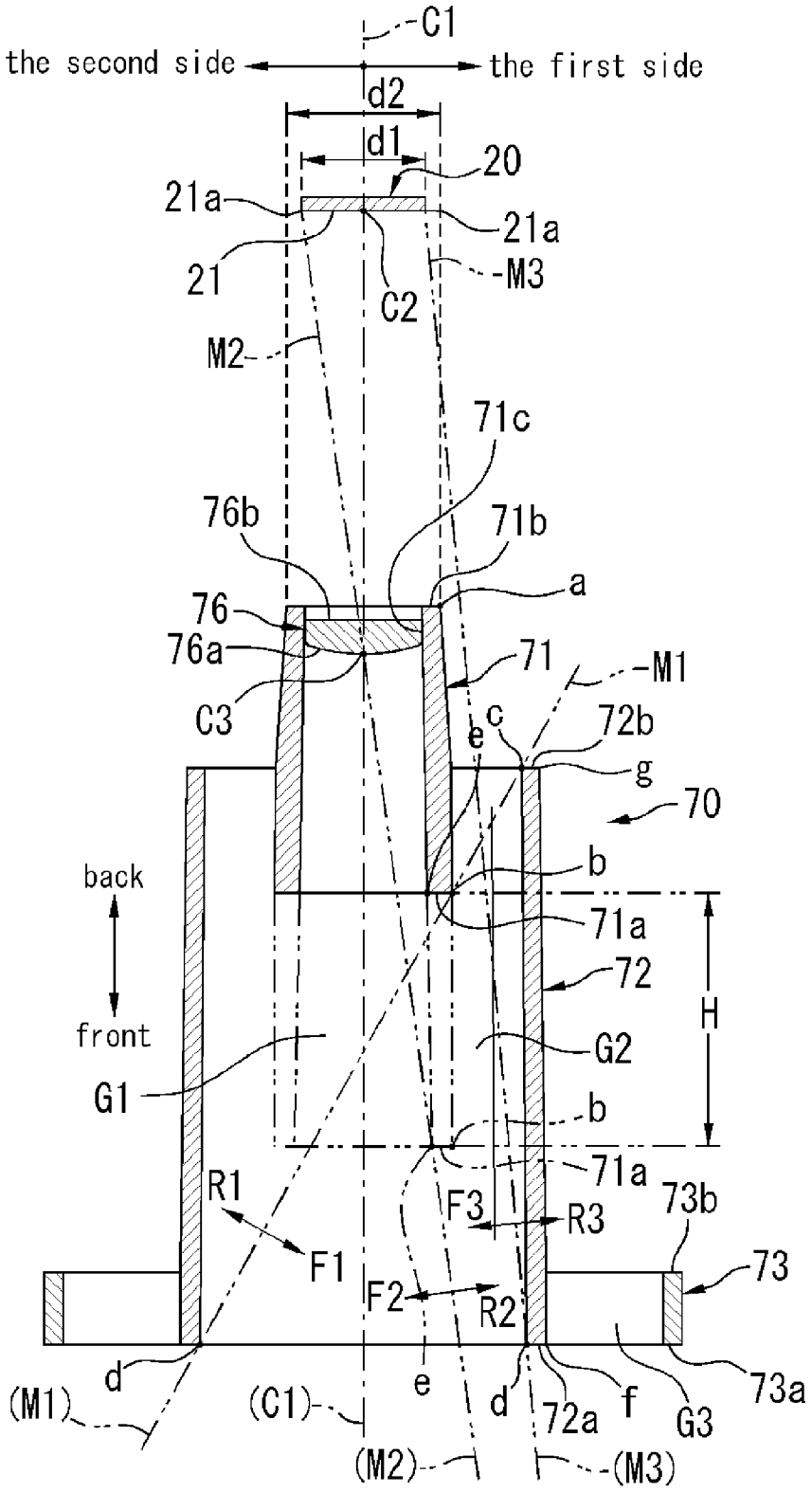
FIG. 5 is a schematic view of the sharpener 70 and a light source 20, in a cross section cut by a plane that includes an axis C1.
Figure 6:
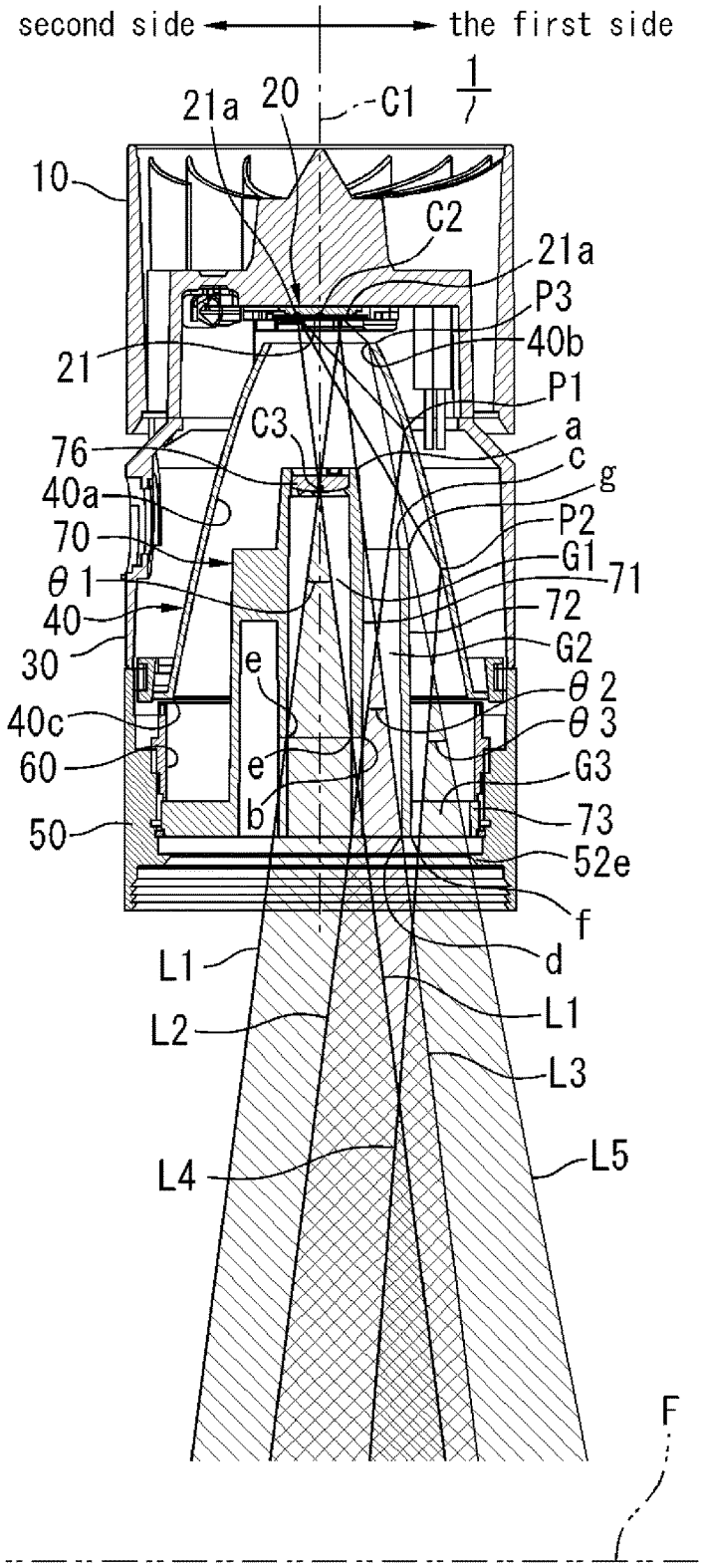
FIG. 6 is an optical path diagram, illustrating optical paths of the light emitted from the light source 20 in the lighting fixture 1.

FIG. 3 is an exploded oblique view of the sharpener 70 viewed from its back end side. FIG. 4 is an oblique view of the sharpener 70 viewed from its front end side. FIG. 5 is a schematic cross sectional view of the sharpener 70 and the light source 20, cut by a plane that includes the axis C1. FIG. 6 is an optical path diagram, illustrating optical paths of the light emitted from the light source 20 in the lighting fixture 1.

As illustrated in these drawings, the sharpener 70 comprises an inner louver portion 71, an outer louver portion 72, a mounting ring portion 73, first arm portions 74, and second arm portions 75. In addition, a condenser lens 76 is mounted in the sharpener 70.

The inner louver portion 71 has a substantially cylindrical shape, with reference to (around) the axis C1. As illustrated in FIG. 5, when an edge surface on the front side of the inner louver portion 71 is defined as a front end 71*a* and when an edge surface on the back side is defined as a back end 71*b*, a lens mounting portion 71*c* is provided on a back end side (near the back end 71*b*) of the inner louver portion 71. The condenser lens 76 mounted to the lens mounting portion 71*c* is a convex lens, whose front surface 76*a* is a convex surface and whose back surface 76*b* is a plane surface, as illustrated in FIG. 2B and FIG. 5. A point at which the front surface 76*a* and the axis C1 intersect with each other becomes the center C3 of the condenser lens 76.

As illustrated in FIG. 2B, in the lens mounting portion 71*c*, protruding portions 71*d* are disposed on its front end side on the inner periphery surface and lug portions 71*e* are disposed on its back end side. The protruding portions 71*d* are formed at positions, at which the inner periphery surface is divided into three equal parts. Each protruding portion 71*d* is formed by four tilted surfaces whose inner side being tapered. The tilted surface on the back side becomes a mounting surface 71*f*, tilting forward toward the center. On the other hand, the lug portions 71*e* are disposed among the three protruding portions 71*d* described above in a circumferential direction. Slits S in a direction along the axis C1 are formed on both sides of each of the lug portions 71*e* in the circumferential direction. The lug portions 71*e* are elastically deformable in expanding and shrinking radial directions thanks to the slits S. A protruding engagement lug 71*g* is provided on the inner side of the lug portion 71*e*.

The condenser lens 76 is mounted in the lens mounting portion 71*c*, as described below. The front surface 76*a* of the condenser lens 76 is opposed to an opening of the back end 71*b* of the inner louver portion 71. The back surface 76*b* of the condenser lens 76 is pressed forward along the axis C1. At this time, the lug portion 71*e* is elastically deformed and expands outward, due to the condenser lens 76 abutting on the engagement lug 71*g*. This expansion allows the condenser lens 76 to pass therethrough. The condenser lens 76 will not be pressed in any further when the front surface 76*a* of the condenser lens 76 abuts on the protruding portions 71*d*. At the substantially same time, the back surface 76*b* of the condenser lens 76 finishes passing through the engagement lug 71*g*. This allows the lug portion 71*e* to be returned to its original shape due to the elasticity, and then the lug portion 71*e* engages with the peripheral edge of the back surface 76*b* of the condenser lens 76. As described above, the condenser lens 76 is mounted in the lens mounting portion 71*c*, and properly positioned.

As illustrated in FIG. 5, when the outer periphery edge of the back end 71*b* of the inner louver portion 71 is defined as a back end side outer periphery edge a, a relation of $d1 \leq d2$ is obtained between the diameter d2 of the back end side outer periphery edge a of the inner louver portion 71 and the diameter d1 of the light-emitting surface 21 of the light source 20, in the present embodiment. The example illustrated in FIG. 5 shows $d1 < d2$.

This relation is further explained later, after the whole sharpener 70 is generally described.

As illustrated in FIG. 2B, a knurled portion 71*h* is provided on the inner peripheral surface of the inner louver portion 71 in a portion excepting the lens mounting portion 71*c* described above. The knurled portion 71*h* is provided for the purpose of diffusing reflected light, and is formed by repetitively providing a pattern of a protruding thread and a recessed thread, both in a front-back direction along the axis C1, in a circumferential direction.

Inside of the inner louver portion 71 is a cylindrical first space G1, as illustrated in FIG. 5.

The outer louver portion 72 has a substantially cylindrical shape, with reference to (around) the axis C1, which is a reference common with the inner louver portion 71, and having a diameter greater than the diameter of the inner louver portion 71. The inner louver portion 71 and the outer louver portion 72 are concentrically disposed around the axis C1. The outer louver portion 72 is disposed to cover the front end 71*a* side of the inner louver portion 71. A second space G2, which is an annular (toroidal) gap, is formed between the inner louver portion 71 and the outer louver portion 72. When an edge surface of the front side of the outer louver portion 72 is defined as a front end 72*a*, and when an edge surface of the back side of the outer louver portion 72 is defined as a back end 72*b*, a knurled portion 72*c* (see FIG. 3) is provided on the inner peripheral surface of the outer louver portion 72, throughout the length from the front end 72*a* to the back end 72*b*. The knurled portion 72*c* is similar to the knurled portion 71*h* of the inner louver portion 71.

As illustrated in FIGS. 3 and 4, the outer louver portion 72 and the inner louver portion 71 are connected by the first arm portions 74. Each first arm portion 74 has a long plate-like shape in a front-back direction. The first arm portions 74 are disposed at positions, at which the back end of the second space G2 is divided into three equal parts in a circumferential direction. The first arm portions 74 connect the outer periphery surface of the inner louver portion 71 and the inner periphery surface of the outer louver portion 72.

The mounting ring portion 73 has a substantially cylindrical shape, having a diameter larger than the diameter of the outer louver portion 72, and around the common axis C1. The mounting ring portion 73 is concentrically disposed with respect to the inner louver portion 71 and the outer louver portion 72 described above. The mounting ring portion 73 has a cylindrical shape whose length in the direction along the axis C1 is shorter than those of the inner louver portion 71 and the outer louver portion 72. The mounting ring portion 73 is disposed to cover the vicinity of the front end 72*a* of the outer louver portion 72. A third space G3, which is an annular (toroidal) gap, is formed between the outer louver portion 72 and the mounting ring portion 73. When an edge surface of a front side of the mounting ring portion 73 is defined as a front end 73*a* and when an edge surface of a back side of the mounting ring portion 73 is defined as a the back end 73*b*, a knurled portion 73*c* is provided on the inner peripheral surface of the mounting ring portion 73 throughout the length from the front end 73*a* to the back end 73*b*. The knurled portion 73*c* is similar to the knurled portion 71*h* of the inner louver portion 71.

The mounting ring portion 73 and the outer louver portion 72 are connected by the second arm portions 75. Each second arm portion 75 has a plate-like shape with its longitudinal direction being in a radial direction. The second arm portions 75 are disposed at positions, at which the third space G3 is divided into three equal parts in a circumferential direction. The second arm portions 75 connect the outer periphery surface of the outer louver portion 72 and the inner periphery surface of the mounting ring portion 73. The positions of the three second arm portions 75 in a circumferential direction are set to be same as the positions of the three first arm portions 74. An annular notch portion 73*d* (see FIG. 2C) is formed on the outer periphery of the front end 73*a* of the mounting ring portion 73, all around.

In the sharpener 70 described above, the portions excepting the condenser lens 76, i.e., the inner louver portion 71, the outer louver portion 72, the mounting ring portion 73, the first arm portion 74, and the second arm portion 75 are integrally formed. As a result, the number of components can be reduced down to one and thus the number of assembly steps can be reduced, compared with a case where these components are separately formed and then assembled.

The sharpener 70 with the configuration as described above is mounted (positioned and fixed) inside of the hood 50 by the mounting ring portion 73, which is held between the snap ring R and the holder 60, as illustrated in FIG. 2A and FIG. 2C.

The snap ring R is engaged with the ring engagement groove 52*c* on the inner periphery surface of the hood 50. The annular notch portion 73*d* of the front end 73*a* of the mounting ring portion 73 is engaged with the snap ring R. On the other hand, on the inner peripheral surface of the hood 50, the female screw portion 52*a* is threaded as described above, and the male screw portion 60*a* of the holder 60 is screwed into the female screw portion 52*a*. As a result, the back end 73*b* of the mounting ring portion 73 is pressed by the pressing portion 60*b* of front end of the holder 60. This pressing allows the mounting ring portion 73 to be held between the snap ring R and the holder 60. As a result, the whole sharpener 70 is positioned and fixed at a predefined position, as illustrated in FIG. 2A.

In the condition where the sharpener 70 is positioned as described above, the back ends of the inner louver portion 71 and the outer louver portion 72 of the sharpener 70 are inserted into the reflector 40. In addition, the mounting ring portion 73 and the holder 60 located on the back end side of the mounting ring portion 73 together form so to speak a third louver portion. At this time, the back end of the holder 60 is located close to the light emission outlet 40*c* of the reflector 40, and thus light leakage therebetween and occurrence of unwanted reflection are prevented.

Relative positioning of each component of the sharpener 70, and optical paths of the light emitted from the light-emitting surface 21 of the lighting fixture 1 are described with reference to FIGS. 5 and 6. Note that the position of the sharpener 70 being mounted as illustrated in FIG. 6 differs from the position of the sharpener 70 being mounted as illustrated in FIG. 2A. In other words, in FIG. 2A, the sharpener 70 is mounted by holding the mounting ring portion 73 between the snap ring R and the holder 60, in a state where the protective glass housing portion 52*d* as a space is fixed on the immediately front side of front end of the sharpener 70. Therefore, even when a disk-shaped protective glass is mounted on the support protruding portion 52*e* by using the snap ring R, the position of the sharpener 70 to be mounted does not change. In this case, since the position of the sharpener 70 to be mounted does not change regardless of whether or not the protective glass is mounted, optical paths of the light emitted from the light-emitting surface 21 of the light source 20 match with one another with high accuracy.

In contrast, the sharpener 70 illustrated in FIG. 6 does not have a protective glass housing portion 52*d*, and is mounted by causing the front end 73*a* of the mounting ring portion 73 of the sharpener 70 to abut on the support protruding portion 52*e*, and by holding the mounting ring portion 73 between the support protruding portion 52*e* and the holder 60. In this case, the snap ring R is not needed.

In the description above, explanation is given about the protective glass (not shown). However, instead of the protective glass (not shown), this explanation may be applicable to, for example, about whether or not an optional disk-shaped filter (not shown) is mounted.

General explanation of the sharpener 70 is as described above.

Special configuration, effects, and advantages of the sharpener 70 are now described below.

For the purpose of explanation, the axis C1 in FIGS. 5 and 6 is used to define a boundary, and the right side of the axis C1 is defined as a first side, and the left side is defined as a second side.

As illustrated in FIG. 5, the diameter of the edge portion 21*a* of the light-emitting surface 21 of the light source 20 is defined as a diameter d1 (same as the diameter of the light-emitting surface 21), and the diameter of the back end side outer periphery edge a of the inner louver portion is defined as a diameter d2.

A straight line that passes through a back end side inner periphery edge c on the first side of the outer louver portion 72 and also passes through a front end side inner periphery edge d on the second side is defined as a first reference line M1. In addition, a straight line that passes through the edge portion 21*a* on the second side of the light-emitting surface 21 of the light source 20 and also passes through the center C3 of the condenser lens 76 is defined as a second reference line M2. In addition, a straight line that passes through the edge portion 21*a* on the first side of the light-emitting surface 21 and also passes through the front end side inner periphery edge d on the first side of the outer louver portion is defined as a third reference line M3.

Based on these definitions, the sharpener 70 of the present embodiment is configured as described below, and exhibits effects and advantages as described below.

(1) The sharpener 70 comprises the inner louver portion 71 and the outer louver portion 72, each formed cylindrically. The inner louver portion 71 and the outer louver portion 72 are concentrically disposed around the axis C1 that extends forward from the center C2 of the light-emitting surface 21. Respective back ends 71*b*, 72*b* of the inner louver portion 71 and the outer louver portion 72 are disposed nearer to the light-emitting surface 21, and their respective front ends 71*a*, 72*a* are disposed farther from the light-emitting surface 21. In addition, the front end 71*a* of the inner louver portion 71 is located nearer to the light-emitting surface 21 than the front end 72*a* of the outer louver portion 72 is.

As illustrated in FIG. 6, the light emitted from the front end of the first space G1, which is inside of the inner louver portion 71, is defined as a first emission light. In addition, the light emitted from the front end of the second space G2, which is between the inner louver portion 71 and the outer louver portion 72, is defined as a second emission light. In addition, the light emitted from the front end of the third space G3, which is between the outer louver portion 72 and the mounting ring portion 73, is defined as a third emission light. Emission angles of each of the first emission light, the second emission light, and the third emission light are respectively defined as a first emission angle θ1, a second emission angle θ2, and a third emission angle θ3.

Based on these definitions, since the sharpener 70 is configured such that the front end 71*a* of the inner louver portion 71 is located nearer to the light-emitting surface 21 than the front end 72*a* of the outer louver portion 72 is, among the first emission light that enters from the back end 71*b* of the inner louver portion 71 and passes through the first space G1 and goes out from the front end 71*a*, the amount of the light that travels away from the axis C1 can be increased and the first emission angle θ1 can be increased, compared with a case where the front ends 71*a*, 72*a* of the inner louver portion 71 and the outer louver portion 72 are located at the same position.

In addition, among the second emission light that enters from the back end of the second space G2, which is between the inner louver portion 71 and the outer louver portion 72, and passes through the second space G2 and goes out from the front end, the amount of the light that approaches the axis C1 can be increased, and the second emission angle θ2 can be increased.

In addition, the first emission angle θ1 of the first emission light emitted from the first space G1 and the second emission angle θ2 of the second emission light emitted from the second space G2 can be made substantially same, by adjusting as appropriate under the condition where the position of the front end 71*a* of the inner louver portion 71 is located nearer to the light-emitting surface 21 than the front end 72*a* of the outer louver portion 72 is. In this case, a substantially same region can be irradiated by the first emission light and second emission light, thereby soft light is obtained.

(2) The portion of the front end side outer periphery edge b of the inner louver portion 71 appeared on the first side in the cross section is located on the first reference line M1 or forward than the first reference line. In other words, when the first reference line M1 is used to define a boundary to divide a plane into two regions (a region of an arrow F1 and a region of an arrow R1), the portion of the front end side outer periphery edge b appeared on the first side in the cross section belongs to the region of the arrow F1, including the first reference line M1.

As a result, the inner louver portion 71 can adjust (control) the amount of light and the emission angle (see the second emission angle θ2 in FIG. 6) of the light that goes out from the second space G2 and approaches the axis C1.

In an opposite situation, i.e., if the front end side outer periphery edge b of the inner louver portion 71 is located backward than the first reference line M1, then the light that passes on the first reference line M1 does not strike the front end 71*a* of the inner louver portion 71. As a result, the front end 71*a* of the inner louver portion 71 is no longer capable of controlling (adjusting) the light amount and the second emission angle θ2 of the light that goes out from the second space G2 and then approaches the axis C1.

(3) The portion of the front end side inner periphery edge e of the inner louver portion 71 appeared on the first side in the cross section is located on the second reference line M2 or backward than the second reference line M2. In other words, when the second reference line M2 is used to define a boundary to divide a plane into two regions (a region of an arrow F2 and a region of an arrow R2), the portion of the front end side inner periphery edge e appeared on the first side in the cross section belongs to the region of the arrow R2, including the second reference line M2.

As a result, the inner louver portion 71 does not reduce the amount of light that goes out from the light-emitting surface 21 and passes through and goes out from the first space G1.

In an opposite situation, i.e., if the front end side inner periphery edge e of the inner louver portion 71 is located forward than the second reference line M2, then the amount of light and the emission angle of the light that goes out from the inner louver portion 71 would be inadvertently reduced.

The inner louver portion 71 satisfies all the conditions described above in (1) to (3) only when the front end 71*a* is located within a range H shown in FIG. 5. In other words, this is when the front end 71*a* is located between the position illustrated by a solid line, at which the front end side outer periphery edge b is located on the first reference line M1, and the position illustrated by a double-dashed chain line, at which the front end inner periphery edge e is located on the second reference line M2. In other words, the position of the front end 71*a* can be changed as appropriate in the range H.

(4) The back end 71*b* of the inner louver portion 71 is disposed nearer to the light-emitting surface 21 than the back end 72*b* of the outer louver portion 72 is.

This configuration allows the inner louver portion 71 to increase the amount of light that goes out from the light-emitting surface 21 and then enters from the back end 71*b* of the inner louver portion 71.

(5) The distance from the axis C1 to the back end side outer periphery edge a of the inner louver portion 71 (d2/2) is longer than the distance from the axis C1 to the edge portion 21*a* of the light-emitting surface 21 (d1/2). In other words, the diameter d2 of the back end side outer periphery edge a is set to be greater than the diameter d1 of the edge portion 21*a* of the light-emitting surface 21 (d2>d1).

This configuration allows the inner louver portion 71 to prevent the direct light that approaches the axis C1 from being included in the light that goes out from the light-emitting surface 21 and is then emitted from the second space G2.

(6) The back end side outer periphery edge a of the inner louver portion 71 is located on the third reference line M3 or nearer to the axis C1 than the third reference line M3. In other words, when the third reference line M3 is used to define a boundary to divide a plane into two regions (a region of an arrow F3 and a region of an arrow R3), the portion of the back end side outer periphery edge a appeared on the first side in the cross section belongs to the region of the arrow F3, including a position on the third reference line M3.

In this case, a portion of the light emitted from the vicinity of the edge portion 21*a* of the light-emitting surface 21 passes outside of the back end side outer periphery edge a, and passes through the second space, and passes inside of the front end side inner periphery edge d of the outer louver portion 72, and is then emitted as direct light traveling in a direction away from the axis C1.

(7) When the back end side outer periphery edge a of the inner louver portion 71 is located farther from the axis C1 than the third reference line M3 is (in a case where it belongs to the region of the arrow R3), the light that goes out from the light-emitting surface 21 and passes through the second space G2 is not emitted as direct light. In other words, it is possible to make all the light emitted from the second space G2 to be indirect light, which is controlled, for example by the reflector 40 (see FIG. 6) or the like.

(8) The sharpener 70 comprises the inner louver portion 71, the outer louver portion 72, the annular mounting ring portion 73 disposed outside of the outer louver portion 72, the first arm portions 74 that connect the inner louver portion 71 and the outer louver portion 72, and the second arm portions 75 that connect the outer louver portion 72 and the mounting ring portion 73.

As a result, the inner louver portion 71 and the outer louver portion 72 can be disposed in predefined positions by holding the mounting ring portion 73, for example inside of the hood 50 by means of the hood 50.

(9) In the sharpener 70, the inner louver portion 71, the first arm portions 74, the outer louver portion 72, the second arm portions 75, and the mounting ring portion 73 are integrally formed.

As a result, the number of components and the number of assembly steps can be reduced, compared with a case where these components are separately formed and then assembled.

With reference to the optical path diagram of FIG. 6, the effects and advantages of the lighting fixture 1, in which the sharpener 70 described above is incorporated, is described.

Optical paths (light) L1 to L5 in FIG. 6 are as described below.

Two optical paths designated by L1, L1 are optical paths of the light, which goes out from the edge portion 21*a* of the light-emitting surface 21 on the first side and on the second side, and passes through the center C3 of the condenser lens 76 and through the first space G1, and is then emitted. The optical path L1 coincides with the second reference line M2 illustrated in FIG. 5. The optical paths L1, L1 respectively pass through the front end side inner periphery edges e, e of the inner louver portion 71 on the first side and on the second side. The angle formed by the two optical paths L1, L1 becomes the first emission angle θ1. The light within the range of the first emission angle θ1 becomes direct light. In other words, in the illustrated example, the light emitted from the first space G1 (first emission light) is direct light.

An optical path designated by L2 is an optical path of the light, which is emitted from the edge portion 21*a* of the light-emitting surface 21 on the second side, and reflected on a point P1 on the reflection surface 40*a* of the reflector 40, and then passes through the second space G2 and through the front end side outer periphery edge b of the inner louver portion 71, and is then emitted.

An optical path designated by L3 is an optical path of the light, which goes out from the edge portion 21*a* of the light-emitting surface 21 on the first side, passes through the second space G2 and through the front end side inner periphery edge d of the outer louver portion 72, and is then emitted. The optical path L3 coincides with third reference line M3 illustrated in FIG. 5. In addition, in the illustrated example, the optical path L3 passes through the back end side outer periphery edge a of the inner louver portion 71.

The angle formed by the optical path L2 and the optical path L3 becomes the second emission angle θ2. The light within the range of the second emission angle θ2 becomes indirect light. In other words, in the illustrated example, the light emitted from the second space G2 (second emission light) is indirect light that is reflected on the reflection surface 40*a*. If the back end side outer periphery edge a of the inner louver portion 71 is located nearer to the axis C1 than the third reference line M3 is, as illustrated in FIG. 5, then direct light is partly included in the light that is emitted from the second space G2. Note that, in terms of enhancing controllability of the emission light, it would be preferable that direct light is not included in the light that is emitted from the second space G2.

An optical path designated by L4 is an optical path of indirect light, which is emitted from the edge portion 21*a* of the light-emitting surface 21 on the second side, and reflected at a point P2 on the reflection surface 40*a*, and then passes through the third space G3, and through vicinity of the front end side outer periphery edge f of the outer louver portion 72.

An optical path designated by L5 is an optical path of indirect light, which is emitted from the edge portion 21*a* of the light-emitting surface 21 on the first side, and reflected at a point P3 on the reflection surface 40*a*, and then passes through the back end side outer periphery edge g of the outer louver portion 72, and through the third space G3, and through the inner edge of the support protruding portion 52*e* of the hood 50.

The angle formed by the optical path L4 and the optical path L5 becomes the third emission angle θ3. The light within the range of the third emission angle θ3 becomes indirect light. In other words, in the illustrated example, the light emitted from the third space G3 (third emission light) is indirect light that is reflected on the reflection surface 40*a*.

In the description above, the light of the second emission angle θ2 emitted from the second space G2 and the light of the third emission angle θ3 emitted from the third space G3 have been explained only for light on the first side. However, this explanation may be applicable also for the light on the second side.

The lighting fixture 1 in the present embodiment is configured such that each of the first emission angle θ1, the second emission angle θ2, and the third emission angle θ3 is within ±5 degrees from a predefined emission angle.

As a result, the optical path L1, the optical path L2, and the optical path L4 on the first side become substantially in parallel one another, and the optical path L1, the optical path L3, and the optical path L5 on the second side become substantially in parallel one another. Therefore, the light emitted from the first space G1, the second space G2, and the third space G3 substantially overlay with one another, thereby an irradiated region F is formed. As a result, the irradiated region F with soft and highly uniform light can be obtained.

DESCRIPTION OF REFERENCES

1 lighting fixture
10 socket
20 light source
21 light-emitting surface
21*a* edge portion of the light-emitting surface
30 body
40 reflector
50 hood
60 holder
70 sharpener
71 inner louver portion

71*a* front end of the inner louver portion
71*b* back end of the inner louver portion
72 outer louver portion
72*a* front end of the outer louver portion
72*b* back end of the outer louver portion
73 mounting ring portion
74 first arm portion
75 second arm portion
76 condenser lens
C1 axis
C2 center of the light-emitting surface
C3 center of the condenser lens
a back end side outer periphery edge of the inner louver portion
b front end side outer periphery edge of the inner louver portion
c back end side inner periphery edge of the outer louver portion
d front end side inner periphery edge of the outer louver portion
d1 diameter of the light-emitting surface (diameter of the edge portion of the light-emitting surface)
d2 diameter of the back end side outer periphery edge of the inner louver portion
e front end side inner periphery edge of the inner louver portion
f front end side outer periphery edge of the outer louver portion
g back end side outer periphery edge of the outer louver portion
G1 first space (inside of the inner louver portion)
G2 second space (gap between the inner louver portion and outer louver portion)
G3 third space (gap between the outer louver portion and mounting ring portion)
M1 first reference line
M2 second reference line
M3 third reference line
θ1 first emission angle (emission angle of the first emission light)
θ2 second emission angle (emission angle of the second emission light)
θ3 third emission angle (emission angle of the third emission light)

The invention claimed is:

1. A sharpener comprising:
a cylindrical inner louver portion and a cylindrical outer louver portion, which are concentrically disposed around an axis that extends forward from the center of a light-emitting surface, wherein:
a back end of the inner louver portion and a back end of the outer louver portion are disposed nearer to the light-emitting surface than a front end of the inner louver portion and a front end of the outer louver portion, respectively, the front end of the inner louver portion is disposed nearer to the light-emitting surface than the front end of the outer louver portion, and the back end of the inner louver portion is disposed nearer to the light-emitting surface than the back end of the outer louver portion;
a cross section of the sharpener comprises a plane comprising the axis, the cross section further comprising a first side and a second side relative to the axis;
a first reference line comprises a straight line that passes through a back end side inner periphery edge of the outer louver portion located on the first side and a front end side inner periphery edge of the outer louver portion located on the second side;
a portion of a front end side outer periphery edge of the inner louver portion positioned on the first side in the cross section is located: on the first reference line; or
in a direction away from the light-emitting surface from the first reference line;
and
an outermost diameter of the inner louver portion is larger than an outermost diameter of the light-emitting surface.

2. The sharpener according to claim 1, comprising:
a condenser lens disposed in the vicinity of the back end of the inner louver portion, wherein
a straight line that passes through an edge portion of the light-emitting surface on the second side in the cross section and also passes through the center of the condenser lens is defined as a second reference line, and
a portion of a front end side inner periphery edge of the inner louver portion positioned on the first side in the cross section is located: on the second reference line; or in a direction toward the light-emitting surface from the second reference line.

3. The sharpener according to claim 1, wherein
a straight line that passes through an edge portion of the light-emitting surface on the first side in the cross section and also passes through the front end side inner periphery edge on the first side of the outer louver portion is defined as a third reference line, and
a back end side outer periphery edge of the inner louver portion is located: on the third reference line; or in a portion nearer to the axis than the third reference line.

4. The sharpener according to claim 1, comprising:
an annular mounting ring portion disposed outside of the outer louver portion,
a first arm portion connecting the inner louver portion and the outer louver portion, and
a second arm portion connecting the outer louver portion and the mounting ring portion.

5. The sharpener according to claim 4, wherein the inner louver portion, the first arm portion, the outer louver portion, the second arm portion, and the mounting ring portion are integrally formed.

6. A lighting fixture comprising:
a light source whose axis passes through the center of a light-emitting surface,
a reflector for reflecting light from the light-emitting surface, and
a sharpener for controlling light from the light-emitting surface and the reflector, and for emitting controlled light,
wherein the sharpener comprises the sharpener according to claim 4.

7. The lighting fixture according to claim 6, wherein
light emitted from inside of the inner louver portion of the sharpener is defined as a first emission light,
light emitted from between the inner louver portion and the outer louver portion is defined as a second emission light,
light emitted from between the outer louver portion and the mounting ring portion is defined as a third emission light,
emission angles of the first emission light, the second emission light, and the third emission light in the cross section are respectively defined as a first emission angle, a second emission angle, and a third emission angle, and each of the first emission angle, the second emission angle, and the third emission angle are within ±5 degrees from a predefined emission angle.

* * * * *